US009208650B2

(12) United States Patent
Bramble

(10) Patent No.: US 9,208,650 B2
(45) Date of Patent: Dec. 8, 2015

(54) GAMING SYSTEM AND METHOD OF GAMING

(71) Applicant: Aristocrat Technologies Australia Pty Limited, North Ryde, NSW (AU)

(72) Inventor: Paul Francis Jason Bramble, St Leonards (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 0 days.

(21) Appl. No.: 13/738,423

(22) Filed: Jan. 10, 2013

(65) Prior Publication Data

US 2013/0184057 A1 Jul. 18, 2013

(30) Foreign Application Priority Data

Jan. 12, 2012 (AU) ..... 2012900121

(51) Int. Cl.
*G06F 19/00* (2011.01)
*G07F 17/32* (2006.01)

(52) U.S. Cl.
CPC ..... *G07F 17/3262* (2013.01)

(58) Field of Classification Search
CPC ..... G07F 17/3265; G07F 17/32; G07F 17/34; G07F 17/3211; G07F 17/3244; G07F 17/3262; G07F 17/3267; G07F 17/3295; G07F 17/322; A63F 2001/008; A63F 2003/0017; A63F 9/183; A63F 1/00; A63F 2007/4031; A63F 2250/13; A63F 2300/1075; A63F 2300/8058; A63F 3/00157; A63F 7/027; A63F 9/0468; A63F 5/00; A63F 5/0011; A63F 5/0076; A63F 13/00; A63F 13/12; A63F 13/52; A63F 9/182
See application file for complete search history.

(56) References Cited

U.S. PATENT DOCUMENTS

| | | | | |
|---|---|---|---|---|
| 5,342,049 | A | 8/1994 | Wichinsky et al. | |
| 6,592,458 | B1 | 7/2003 | Ho | |
| 7,056,213 | B2 | 6/2006 | Ching et al. | |
| 7,074,127 | B2 | 7/2006 | Cuddy et al. | |
| 7,094,148 | B2 | 8/2006 | Baerlocher et al. | |
| 7,275,989 | B2 | 10/2007 | Moody | |
| 7,371,173 | B2 * | 5/2008 | Gatto et al. | 463/20 |
| 7,393,278 | B2 | 7/2008 | Gerson et al. | |
| 2001/0003710 | A1 | 6/2001 | Abramopoulos et al. | |
| 2004/0127280 | A1 * | 7/2004 | Moody | 463/20 |
| 2005/0215311 | A1 | 9/2005 | Hornik et al. | |
| 2005/0215313 | A1 | 9/2005 | O'Halloran | |
| 2005/0282609 | A1 | 12/2005 | Olive | |
| 2006/0160595 | A1 * | 7/2006 | Gerson et al. | 463/16 |

(Continued)

FOREIGN PATENT DOCUMENTS

| | | | |
|---|---|---|---|
| AU | 2003246066 | A1 | 9/2003 |
| AU | 2007221930 | A1 | 10/2007 |

(Continued)

*Primary Examiner* — Sunit Pandya
(74) *Attorney, Agent, or Firm* — McAndrews, Held & Malloy, Ltd.

(57) ABSTRACT

A method of gaming, game controller and gaming system wherein an amount wagered on a game is determined and symbols selected from a symbol set to display in designated symbol positions, the resulting symbols used to determine a first game outcome. Symbols are re-selected for at least one of the designated symbol positions a number of times depending on the amount wagered, to provide a corresponding number of further game outcomes in which a jackpot prize is eligible to be awarded.

32 Claims, 7 Drawing Sheets

(56) References Cited

U.S. PATENT DOCUMENTS

| | | | | |
|---|---|---|---|---|
| 2006/0166730 | A1 | 7/2006 | Olive | |
| 2006/0199636 | A1 | 9/2006 | Ching et al. | |
| 2006/0199637 | A1 | 9/2006 | Ching et al. | |
| 2006/0223614 | A1 | 10/2006 | Olive | |
| 2006/0252495 | A1* | 11/2006 | Gerson et al. | 463/20 |
| 2006/0264254 | A1 | 11/2006 | Aoki | |
| 2007/0004489 | A1* | 1/2007 | Rodgers et al. | 463/11 |
| 2007/0010316 | A1 | 1/2007 | Baerlocher et al. | |
| 2007/0021175 | A1 | 1/2007 | Rodgers et al. | |
| 2007/0021188 | A1 | 1/2007 | Rodgers et al. | |
| 2007/0060294 | A1 | 3/2007 | Cuddy et al. | |
| 2007/0105610 | A1 | 5/2007 | Anderson | |
| 2007/0111785 | A1 | 5/2007 | Olive | |
| 2007/0161424 | A1 | 7/2007 | Gatto et al. | |
| 2008/0076513 | A1 | 3/2008 | Esses et al. | |
| 2008/0076532 | A1 | 3/2008 | Graham et al. | |
| 2008/0076576 | A1* | 3/2008 | Graham et al. | 463/42 |
| 2008/0102928 | A1 | 5/2008 | Daley | |
| 2008/0153578 | A1 | 6/2008 | Gatto et al. | |
| 2008/0153586 | A1 | 6/2008 | Gatto et al. | |
| 2008/0153587 | A1 | 6/2008 | Yoshimura | |
| 2008/0234033 | A1 | 9/2008 | Berman et al. | |
| 2008/0303217 | A1 | 12/2008 | Snow | |
| 2008/0318660 | A1* | 12/2008 | Nores | 463/20 |
| 2009/0093296 | A1 | 4/2009 | Gerson et al. | |
| 2011/0136562 | A1* | 6/2011 | Loat et al. | 463/20 |
| 2014/0011564 | A1* | 1/2014 | Saunders et al. | 463/20 |

FOREIGN PATENT DOCUMENTS

| | | | |
|---|---|---|---|
| CA | 2111317 | | 7/1994 |
| JP | 2007209372 | A | 8/2007 |
| JP | 2008043370 | A | 2/2008 |
| TW | 544325 | B | 8/2003 |
| WO | 2006076462 | A2 | 7/2006 |
| WO | 2007076514 | A2 | 7/2007 |
| WO | 2007081377 | A2 | 7/2007 |
| WO | 2007081377 | A3 | 7/2007 |

* cited by examiner

GAMING SYSTEM AND METHOD OF GAMING

RELATED APPLICATIONS

This application claims priority to Australian Patent Application No. 2012900121, having a filing date of Jan. 12, 2012, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepping machine provided with reels with each reel carrying several symbols of the set, or a video machine wherein selected symbols are displayed on virtual reels on a graphical display device. Win outcomes can occur based on symbols appearing in one or more horizontal lines, diagonal lines, or any other predetermined way.

It is also known to award high paying prizes, referred to as jackpot prizes, which may be funded from a prize pool. Typically, a portion of a gaming machine's turnover is forwarded to a jackpot prize controller which maintains the prize pool. One common way of awarding a jackpot prize is based on achieving a certain symbol or symbol combination in the game, often referred to as a symbol driven jackpot. However, a problem with this sort of jackpot awarding technique is that the probability of being awarded the jackpot prize (or simply qualifying for the prize) is not tied to the amount wagered in the game and thus does not meet regulatory gaming requirements for many jurisdictions. To overcome this problem, some gaming systems have been modified so as to increase the number of jackpot trigger symbols available for selection in the game, as the wagered amount is increased. However, such modification does not result in any visual enhancement to the player and is not always possible to implement, particularly for games having fixed symbol carriers such as the aforementioned stepper reel gaming machines.

BRIEF SUMMARY OF THE INVENTION

In accordance with a first aspect, the present invention provides a method of gaming comprising the steps of:

- determining an amount wagered on a game;
- spinning a plurality of reels to determine a first game outcome; and
- re-spinning at least one of the reels a number of times based on the wagered amount so as to determine a corresponding number of further game outcomes in which a jackpot prize is eligible to be awarded.

In an embodiment at least one of the number of reels and number of times that the reel(s) are re-spun is selected so as to affect the probability of winning the jackpot prize in the game.

In an embodiment the method comprises the further step of selecting the number or reel re-spins such that a probability of awarding the jackpot prize is proportional to the amount wagered.

In an embodiment non-jackpot prizes are ineligible from being awarded in the further game outcomes.

In an embodiment the method comprises the further step of triggering a secondary game upon an award criterion being met in any of the reel spins, such that during the secondary game a determination is made as to whether to award the jackpot prize.

In an embodiment the award criterion is that a particular symbol, or symbol combination, is displayed resulting from the reel spins.

In an embodiment the method comprises the further step of selecting which reel(s) to re-spin based on reel re-spin criteria.

In an embodiment the selection in based on at least one of the presence and location of special symbols.

In an embodiment the method comprises the further step of allocating a percentage of each wager placed in the game to a jackpot prize pool which funds the jackpot prize.

In an embodiment symbols available for selection in the first reel spin and also available for selection in the reel re-spins.

In an embodiment, for a wager of n credits, the method comprises re-spinning the at least one reel n−1 times.

In an embodiment, for a wager of n credits by m pay lines, the at least one reel is re-spun n×m−1 times.

In an embodiment the method comprises the further step of re-spinning different reels to determine each further game outcome.

In accordance with a second aspect the present invention provides a method of gaming comprising the steps of:

- determining an amount wagered on a game;
- selecting symbols from a symbol set to display in designated symbol positions, the resulting symbols used to determine a first game outcome; and
- re-selecting symbols for at least one of the designated symbol positions a number of times depending on the amount wagered, to provide a corresponding number of further game outcomes in which a jackpot prize is eligible to be awarded.

In an embodiment the first game outcome provides a first opportunity to award a jackpot prize and the further game outcomes each provide further opportunities to award the jackpot prize.

In an embodiment the number of times symbols are re-selected is selected such that a probability of awarding the jackpot prize is proportional to the amount wagered in the game.

In an embodiment non-jackpot prizes are ineligible from being awarded in the further game outcomes.

In an embodiment the method comprises the further step of triggering a secondary game upon an award criterion being met in any of the game outcomes, such that during the secondary game a determination is made as to whether to award the jackpot prize.

In an embodiment, for a wager of n credits, the method comprises performing the step of re-selecting symbols n−1 times.

In an embodiment the game is a card game, such that the step of re-selecting symbols comprises re-drawing one or more drawn cards displaying the symbols.

In an embodiment the game is a dice game, such that the step of re-selecting symbols comprises re-rolling one or more dice and displaying the symbols.

In accordance with a third aspect of the present invention there is provided a game controller for a gaming device operable to display play of a reel game, the game controller comprising:

a wager determination module arranged to determine an amount wagered on a game;

an outcome determiner operable to:

determine a first outcome resulting from a reel spin of a plurality of reels; and determine a number of further game outcomes in which a jackpot prize is eligible to be awarded, the further game outcomes resulting from a corresponding number of selected reel re-spins dependent on the determined wager amount.

In an embodiment at least one of the number of reels and number of times that the reel(s) are re-spun is selected so as to affect the probability of winning the jackpot prize in the game.

In an embodiment the number or reel re-spins is selected such that a probability of awarding the jackpot prize in the game is proportional to the amount wagered.

In an embodiment non-jackpot prizes are ineligible from being awarded in the further game outcomes.

In an embodiment the game controller is further arranged to initiate play of a secondary game upon an award criterion being determined in the first or further game outcomes, such that during the secondary game a determination is made as to whether to award the jackpot prize.

In an embodiment the award criterion is that in a particular symbol, or symbol combination, is determined.

In an embodiment the game controller further comprises a re-selection module arranged to select which reel(s) to re-spin based on determining at least one of the presence and location of a special symbol in any of the game outcomes.

In an embodiment the game controller further comprises a symbol selector arranged to randomly select symbols to display in the first and further game outcomes, wherein symbols available for selection in the first reel spin and also available for selection in the reel re-spins.

In accordance with a fourth aspect of the present invention there is provided a game controller comprising:

a wager determination module arranged to determine an amount wagered on a game;

a symbol selector arranged to:

select symbols from a symbol set to display in symbol positions, the resulting symbols used to determine a first game outcome; and re-select symbols for at least one of the symbol positions a set number of times depending on the amount wagered, to provide a corresponding number of further game outcomes in which a jackpot prize is eligible to be awarded.

In an embodiment the first game outcome provides a first opportunity to award a jackpot prize and the further game outcomes each provide further opportunities to award the jackpot prize.

In accordance with a fifth aspect of the present invention there is provided a gaming system comprising a game controller in accordance with the third or fourth aspects; and at least one gaming device providing a display arranged to display play of the game.

In accordance with a sixth aspect, the present invention provides a computer program comprising instructions for controlling a computer to implement a gaming method or controller in accordance with the first through fourth aspects, respectively.

In accordance with a seventh aspect, the present invention provides a tangible computer readable medium providing a computer program in accordance with the sixth aspect of the invention.

BRIEF DESCRIPTION OF SEVERAL VIEWS OF THE DRAWINGS

Features and advantages of the present invention will become apparent from the following description of embodiments thereof, by way of example only, with reference to the accompanying drawings, in which.

DETAILED DESCRIPTION OF THE INVENTION

In an embodiment there is provided a game controller for a gaming device which is operable to display play of a reel game. The game controller comprises a wager determination module arranged to determine an amount wagered on a game. An outcome determiner implemented by the game controller is operable to determine a first outcome of the game resulting from a reel spin of a plurality of reels. The outcome determiner is further arranged to determine a number of further outcomes of the game in which a jackpot prize is eligible to be awarded. The further game outcomes result from a corresponding number of selected reel re-spins such that the number is dependent on the determined wager amount.

General Construction of a Gaming System

The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 1:
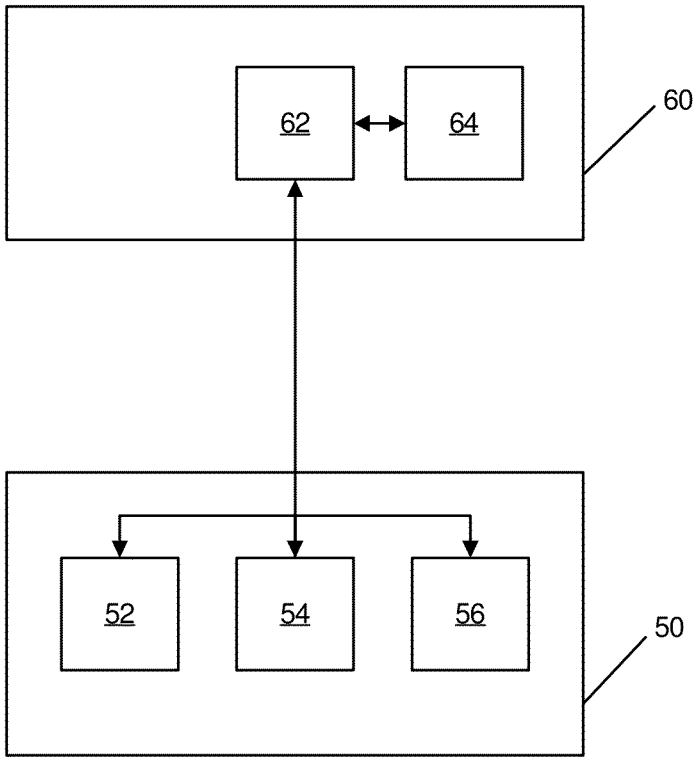
FIG. 1 is a schematic block diagram of core components of a gaming system in accordance with an embodiment of the present invention.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game and observe the game outcomes.

Components of the player interface may vary from embodiment to embodiment but will typically include a credit mechanism 52 to enable a player to input credits and receive payouts, one or more displays 54, a game play mechanism 56 that enables a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
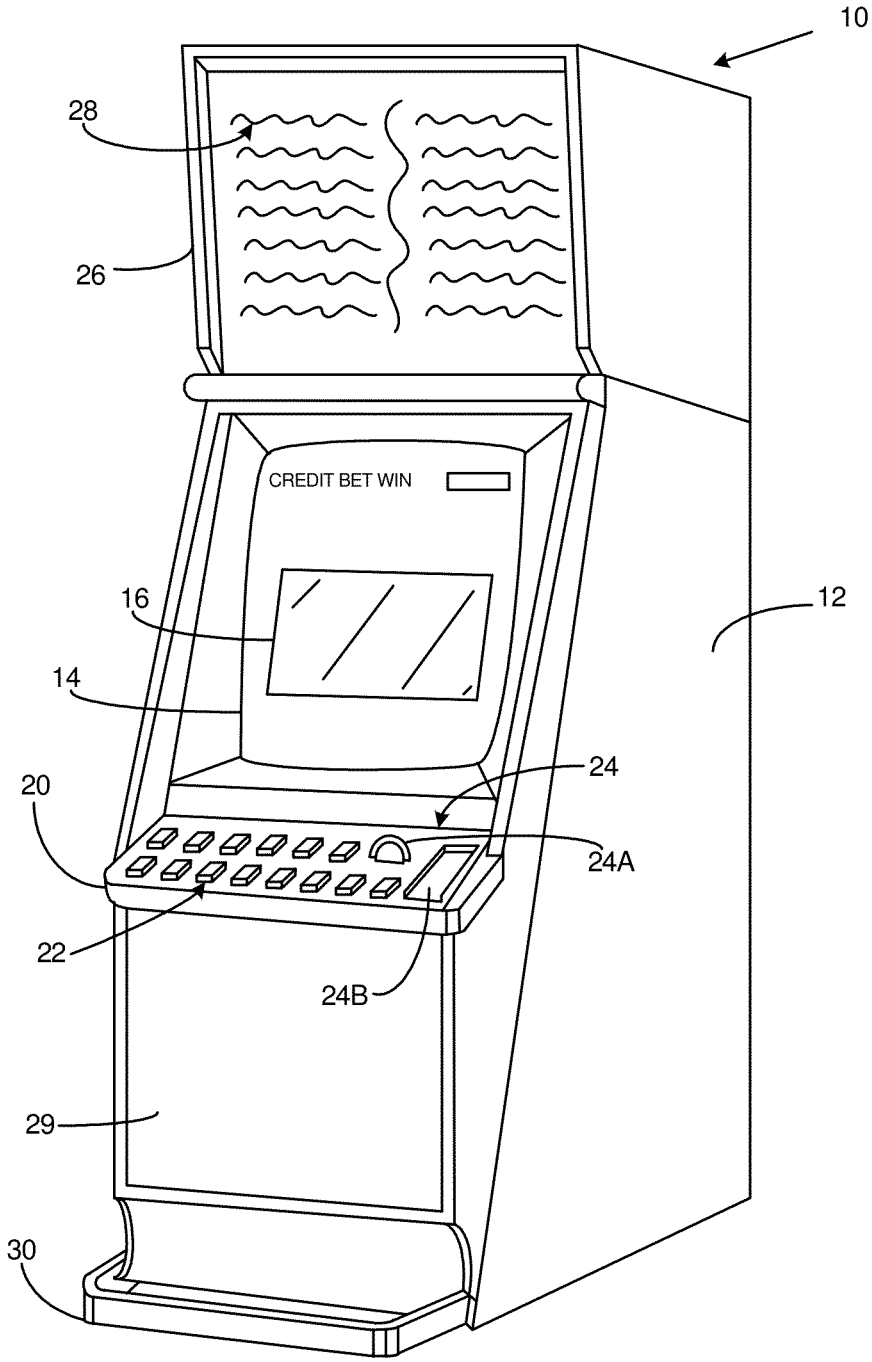
FIG. 2 is a diagrammatic representation of a gaming system in accordance with an embodiment of the present invention with the gaming system implemented in the form of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
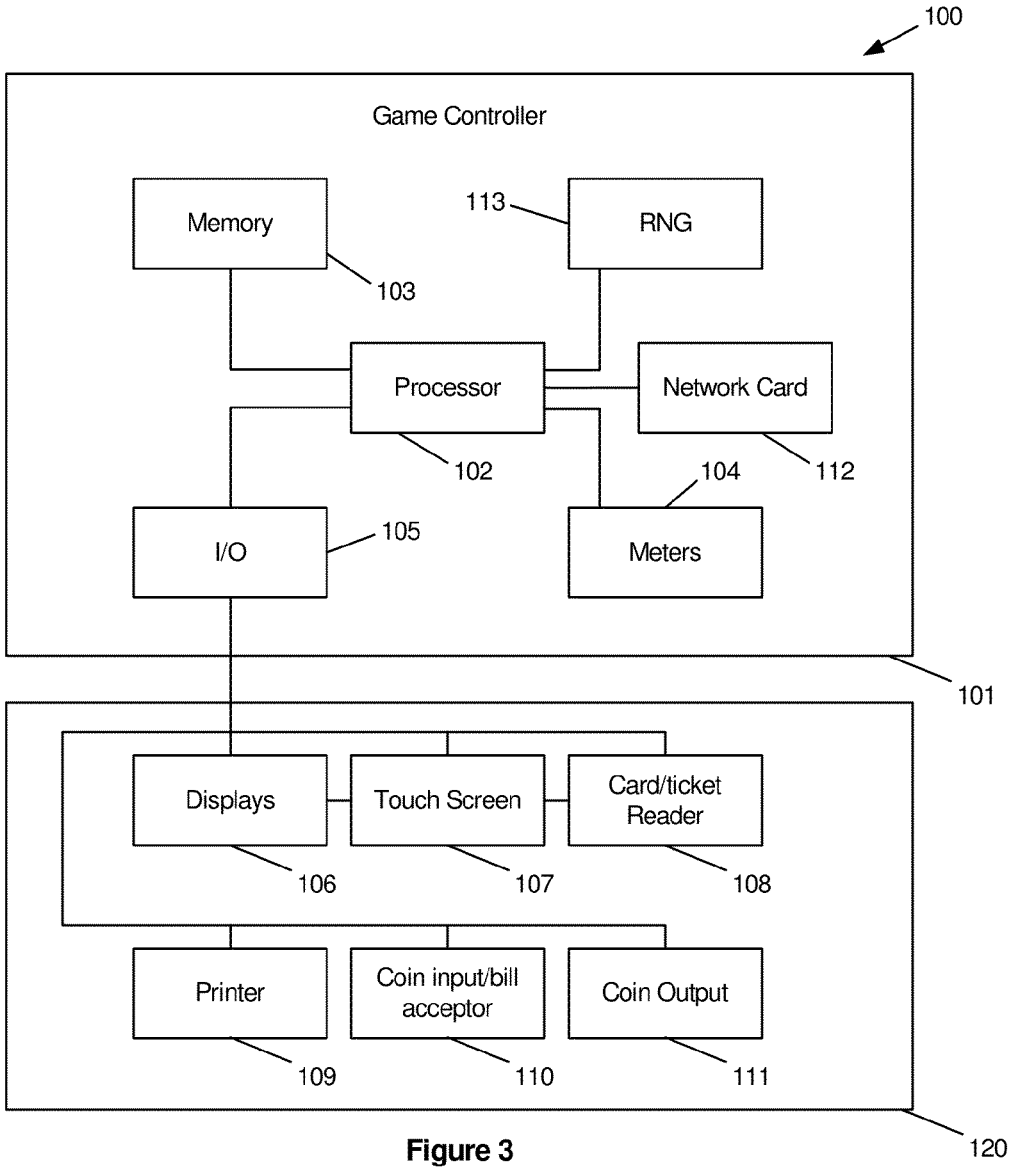
FIG. 3 is a schematic block diagram of operative components of the gaming machine shown in FIG. 2.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a central controller, server or database and receive data or commands from the central controller, server or database. In embodiments employing a player marketing module, communications over a network may be via player marketing module—i.e. the player marketing module may be in data communication with one or more of the above devices and communicate with it on behalf of the gaming machine.

Figure 4:
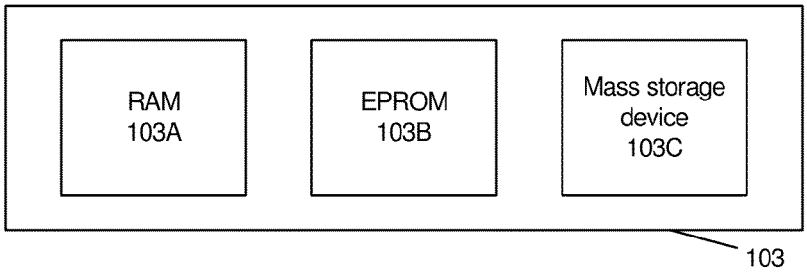
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
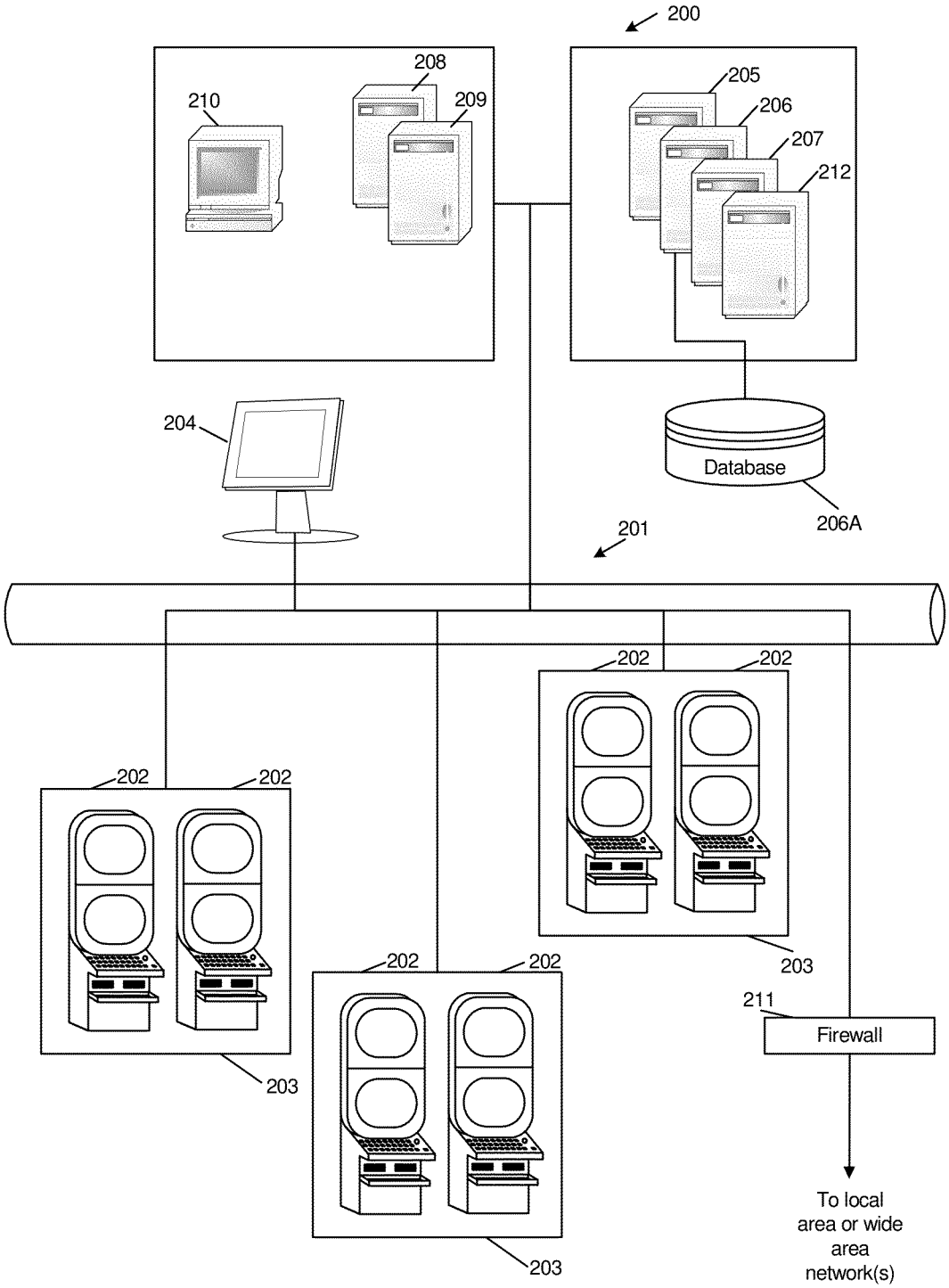
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Persons skilled in the art will also appreciate that the method of the preferred embodiment could be embodied in program code. The program code could be supplied in a number of ways, for example on a computer readable medium, such as a disc or a memory (for example, that could replace part of memory 103) or as a data signal (for example, by downloading it from a server).

Embodiments may be implemented in relation to a spinning reel type game. Gaming systems for implementing games that involve a display of spinning reels as part of the display of the outcome of a game have either a video display or a mechanical display, these later machines most usually being "stepper" machines which have a separate motor for each reel. However, persons skilled in the art will appreciate that the invention can be implemented in respect of other forms of games, including; card games; ball draw games (e.g. bingo or keno); dice games; and pin and ball games.

In some implementations the game controllers of such gaming machines select symbols by employing a stop determining function that randomly determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display that which corresponds to a player playing a single win line. When a reel stops, the symbols will be in one of a plurality of possible symbol positions for that reel relative to the stop position.

Spinning reel type games typically allow a player to select how many win lines of a plurality of win lines they will play in each game—i.e. a minimum of one win line up to the maximum number of win lines allowed by the game. Persons, skilled in the art, will appreciate that in other embodiments, the player may select a number of reels to play. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. Some of the win lines will be horizontal or diagonal lines. Typically, the win lines will be constituted by symbol positions in the visible window. A game outcome is determined based on the symbols on the win lines and a prize table that specifies awards.

More Detail of the Game Controller

Figure 6:
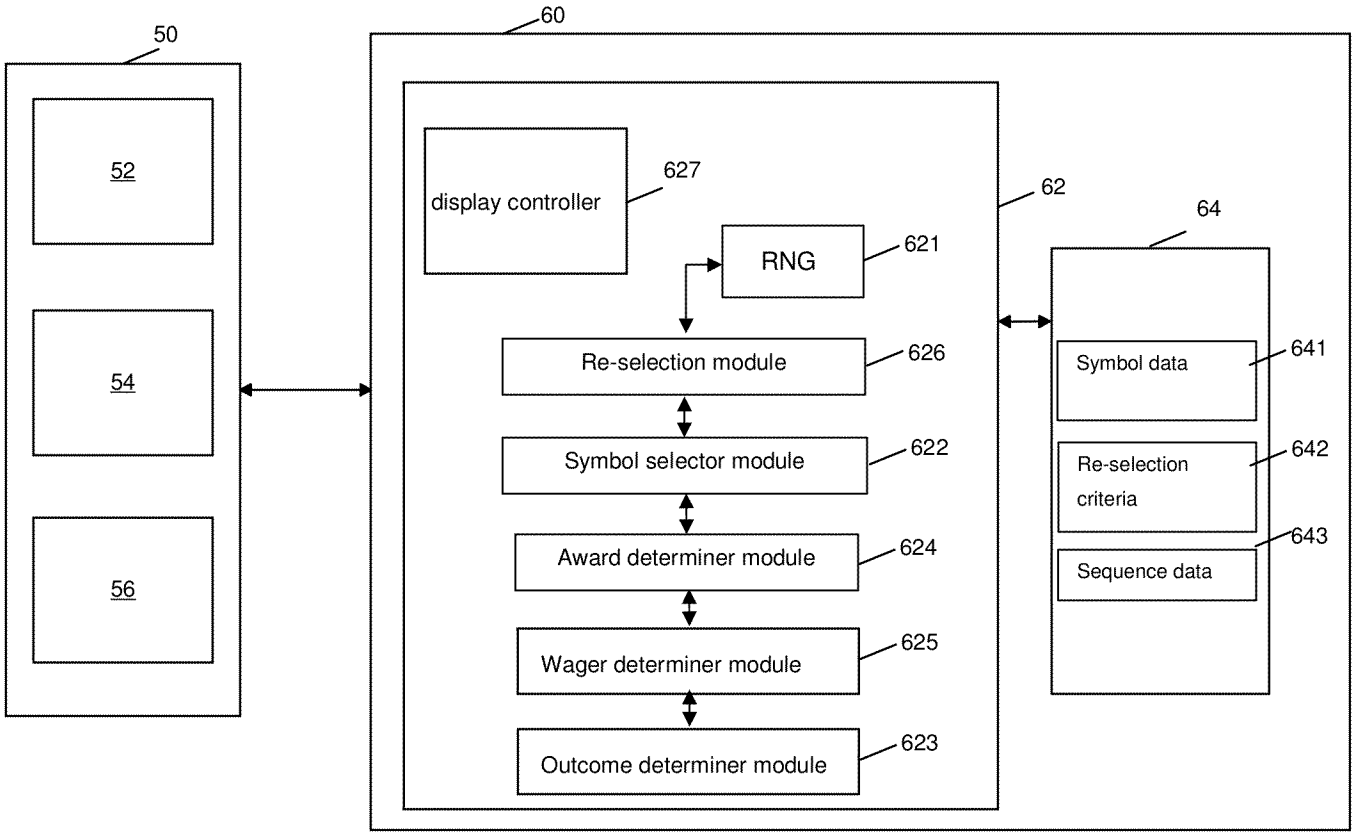
FIG. 6 is a schematic diagram of functional components of a gaming system in accordance with an embodiment of the present invention.
Figure 7:
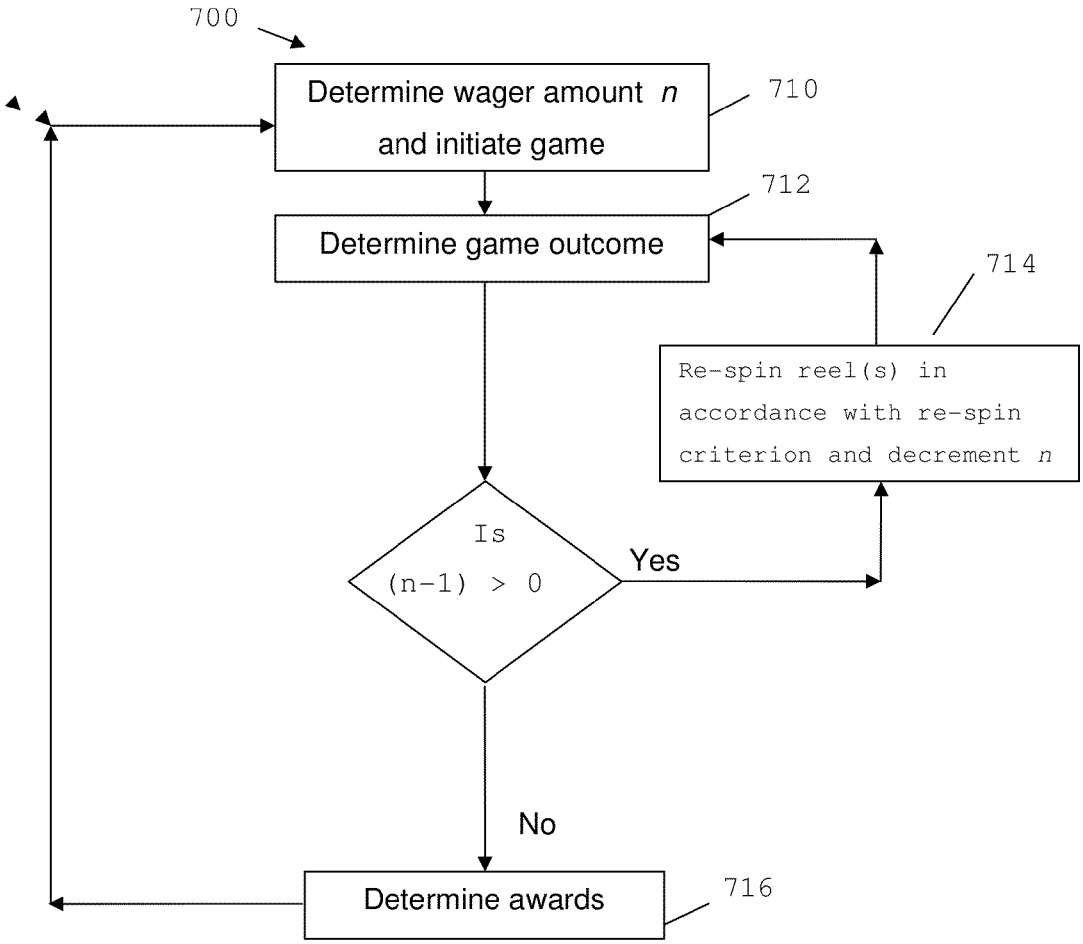
FIG. 7 is a flow diagram illustrating operation of a gaming system in accordance with an embodiment of the present invention.

The game controller 60 of an embodiment is shown in more detail in FIG. 6. As described in the preceding paragraphs, embodiments of the present invention are operable to re-spin or re-select various elements of a game for adjusting probabilities of triggering jackpots, based on an amount wagered in the game. For example, in many jurisdictions it is necessary for the probability of winning or being eligible to be awarded a major jackpot prize to be proportional to an amount wagered by the player in a particular game. Utilising embodiments described herein for a reel game, one or more of the reels can be re-spun a set number of times so as to achieve the required jackpot trigger probability, while at the same time providing a game format which is more visually stimulating and exciting than prior art techniques. For simplicity, only those modules needed to carry out such embodiments are illustrated in FIG. 6. Other standard and/or non-standard modules may also be implemented for carrying out operation of normal and feature game play functionality.

It will be understood that the jackpot prizes may be funded from a jackpot prize pool that is implemented by the game controller 60, or by some remote jackpot controller (e.g. incorporated into the jackpot server 207, as previously described). It follows, that the prize pool may be made up of contributions from a single gaming machine or from a collection of gaming machines that are each eligible to be awarded the jackpot prize. Alternatively, the jackpot prize may be some other major prize that is independent of machine contributions. Such variations are within the purview of the skilled person.

The game controller 60 includes a processor 62 which is arranged to control game play for determine a game outcome. It will be apparent that the processor 62 implements a number of modules, namely random number generator module (RNG) 621, symbol selector module 622, outcome determiner module 623, award determiner module 624, wager determination module 625, re-selection module 626 and display controller module 627, based on data stored in memory 64. Persons skilled in the art will appreciate that not all modules need be implemented by processor 62. For example, the random number generator module 621 could be implemented by a separate circuit or by a random number generator server.

In the following description, embodiments will be described in the context of a game having a plurality of reels (each carrying a plurality of symbols), which are spun to determine game outcomes. However, it will be understood that embodiments are equally applicable to other game types. For example, rather than providing a reel with a number of symbols, a "deck of cards" may be provided, such that certain cards or card combinations may result in a jackpot prize being awarded to the player. According to such an embodiment, selected ones of the cards may be re-drawn, dependent on the wagered amount, to affect the probability of the player being awarded the jackpot prize. A person skilled in the art would understand that such a concept may readily be extended to dice games, numbered ball games, or indeed any type of game of chance where markers with different values/symbols may be re-selected to provide further game outcomes in which jackpot prizes are eligible to be awarded.

During each game of the reel game, the wager determination module 625 of the game controller 60 determines an amount wagered by the player in the game (e.g. by selecting a button corresponding to the wager amount on the gaming machine which causes a signal to be sent to the game controller 60 to notify the game controller of the wager amount). The symbol selector 622 then selects symbols to appear in a first reel spin. Specifically this involves displaying symbols in a reel window displaying a plurality of reels, based on symbol data 641 stored in memory 64 specifying the available symbols. The symbols to appear in the reel window are selected by the symbol selector 622 using a random number obtained from the random number generator 621. The outcome determiner module 623 determines the game outcomes and their associated prizes based on the number of win lines the player is playing, the amount wagered and the symbol combinations. In the presently described embodiment, the game outcomes achievable in the initial reel spin may include both jackpot and non-jackpot (or "standard") game outcomes. The reel window and corresponding game outcomes are displayed on the display 54 under control of the display controller 627.

As will be described in more detail in subsequent paragraphs, after the first outcome has been determined, one or more reels are operable to be re-spun in the same game depending on the wager amount (and optionally a re-spin criteria, as will be described in more detail in subsequent paragraphs) and the reel window modified to display the resultant symbols. Again, this process involves the symbol selector 622 selecting symbols from the available symbols for display in the corresponding re-spun reel location(s). After each one of the reel re-spins, the outcome determiner 623 determines further game outcomes. In the presently described embodiment, the further game outcomes include only jackpot related outcomes so as to only affect the probability of achieving a jackpot prize. However, in an alternative embodiment, the further game outcomes may include both jackpot and non-jackpot related outcomes. According to such an alternative embodiment, the symbols available for selection in each or all reel spins may vary so as to achieve a desired overall return to player (RTP). For example, if after determining a wager of 3 credits which corresponds to two reel re-spins, the number of prize winning symbols ordinarily available for selection may be reduced by a factor of three to ensure the overall return to player for the base game remains unchanged. It should be appreciated that any mechanism may be used to modify the symbols available for re-selection to ensure that the overall required return to player for the base game is maintained.

Jackpot prizes may be awarded in a number of different ways. In one example embodiment, jackpot prizes are awarded upon achieving a particular symbol or symbol combination in any one of the reel spins. In another example embodiment, the player must first qualify to be awarded the jackpot prize and the prize determination made in a secondary game. The secondary game may be triggered upon detecting a particular symbol, or symbol combination, in any of the first or further game outcomes. It will be understood by persons skilled in the art that the jackpot resulting symbol combination may include a combination which awards the jackpot, or one that triggers a feature in which the jackpot may be won, or indeed any other mechanism by which the opportunity to win a jackpot has been changed proportional to the amount wagered in the game.

The method 700 of the invention is summarised in FIG. 700. At step 710 the wager determination module 625 determines an amount wagered on a game. At step 712, a first reel spin is affected and the outcome determined by the outcome determiner 623. The re-selection module 626 inspects re-selection criteria 642 stored in memory to determine whether any reel re-spins are required (step 714). The re-selection criteria may also be used to determine which reel(s) to re-spin. If a positive determination is made, under the control of the re-selection module 626, selected reels are re-spun a number of times corresponding to the wagered amount, to determine further game outcomes and determine any awards (step 716).

The re-selection criteria can include rules for eligibility for re-selections, determination of the number of re-selections, and selection of symbols to be re-selected. Eligibility for re-selections or continuing re-selections may be based on the number of available jackpot prizes and whether or not an outcome including the criterion for awarding a jackpot has occurred in an outcome. For example, stopping re-selections once a jackpot winning symbol combination occurs in a game outcome. Alternatively all re-selections may occur irrespective of whether or not the jackpot criterion is met and rules may define how the jackpot award is determined, for example are different jackpots accumulated or is only the highest value jackpot to be paid at the end of the re-selections.

Rules may be included for determining the number of re-selections, for example in an embodiment a set number of re-selections may be used. In regions where regulations on return to player for jackpots are mandated the rules can define how the number of re-spins is determined to ensure compliance with the mandated return to player. For example, the rules may include formulae for calculating the number of re-selections based on the amount bet. For example, rule may define that for a wager of n credits, at least one reel is re-spun n−1 times. In another example, rules may define that for a wager of n credits by m pay lines, at least one reel is re-spun n×m−1 times.

The re-selection criterion may also be used to determine symbols for re-selection. For example, a set reel may be re-spun or a reel to re-spin selected based on position of jackpot eligibility symbols in the game outcome. For example, a reel to re-spin may be selected to increase the probability of a jackpot eligible outcome occurring. Alternatively a reel to re-spin or symbols for reselection may be randomly selected by the game controller or selected by the player. It should be appreciated that the re-selection criteria can vary between embodiments and may be at least partly dependent on regulatory requirements. The above paragraphs describe some examples only and all possible variations of re-selection criteria are contemplated within the scope of the present invention.

More detailed examples of embodiments will now be described. According to each embodiment, the re-spins are operable to ensure that a probability of qualifying for a jackpot prize is proportional to the amount wagered in the game.

Example 1

Figure 8:
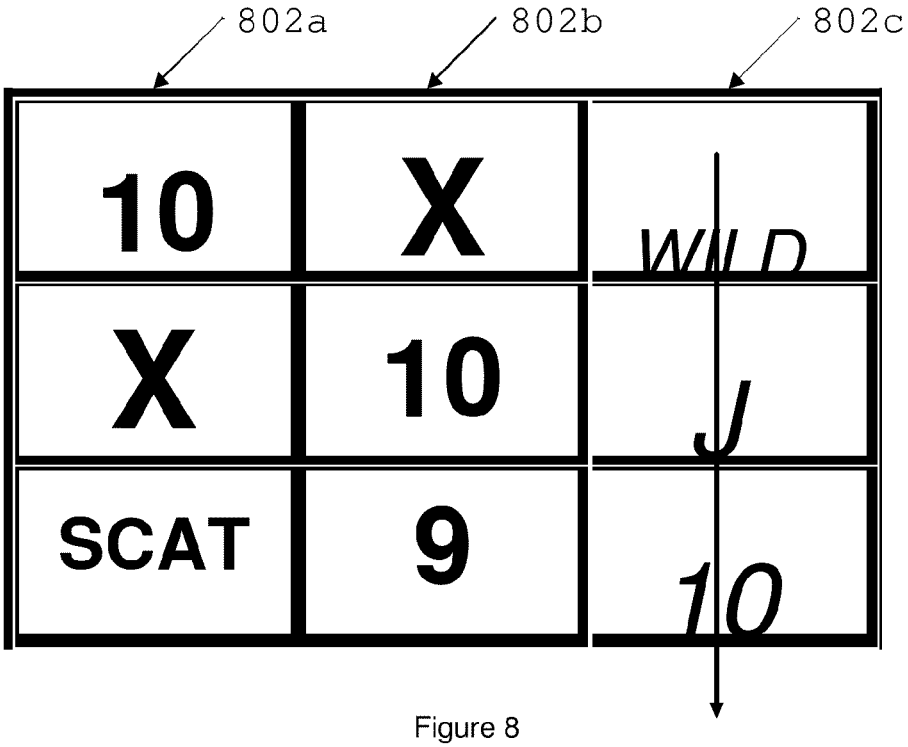
FIGS. 8 & 9 are representations of example displays generated by a gaming system in accordance with an embodiment of the present invention.

FIG. 8 is a screen shot of a reel window for a three-reel poker machine (the reels being designated by reference numeral 802*a*, 802*b*, 802*c*, respectively), in accordance with a first example embodiment. According to this embodiment, in order for a player to be awarded the jackpot prize, the symbol "X" is required to be displayed on each of the three reels in any position (i.e. scattered). There are three evaluation or pay lines available for selection by the player. In the illustrated embodiment, the player has elected to only play two lines and has wagered two credits per line, for a total wager of four credits. To ensure that the probability of awarding a jackpot prize is proportional to the wagered amount, the third reel 802*c* is re-spun three times (i.e. one spin less than the total wager amount) when symbol "X" occurs on the first and second reels 802*a*, 802*b*, thereby providing the player a further three opportunities to be awarded the jackpot prize.

In an embodiment where only one jackpot prize is available to be awarded, if the jackpot criterion is met by a symbol "X" occurring on the third reel 802*c*, then this may terminate the re-spins and the jackpot prize is awarded to the player. In this embodiment all the re-spins available may not be used. In an embodiment, the re-spins may occur irrespective of whether symbol "X" occurs on the third reel 802*c*.

During reel re-spins, no evaluation takes places except in relation to determining a jackpot prize outcome. In an embodiment, if more than one jackpot can be awarded during the game the player may be awarded the total sum value of all jackpot prizes determined based on symbol combinations in each game outcome (i.e. the accumulated jackpot prize pool value). Alternatively, the jackpot prize may be multiplied by the number of jackpot triggering symbol combinations detected in the game.

Example 2

Figure 9:
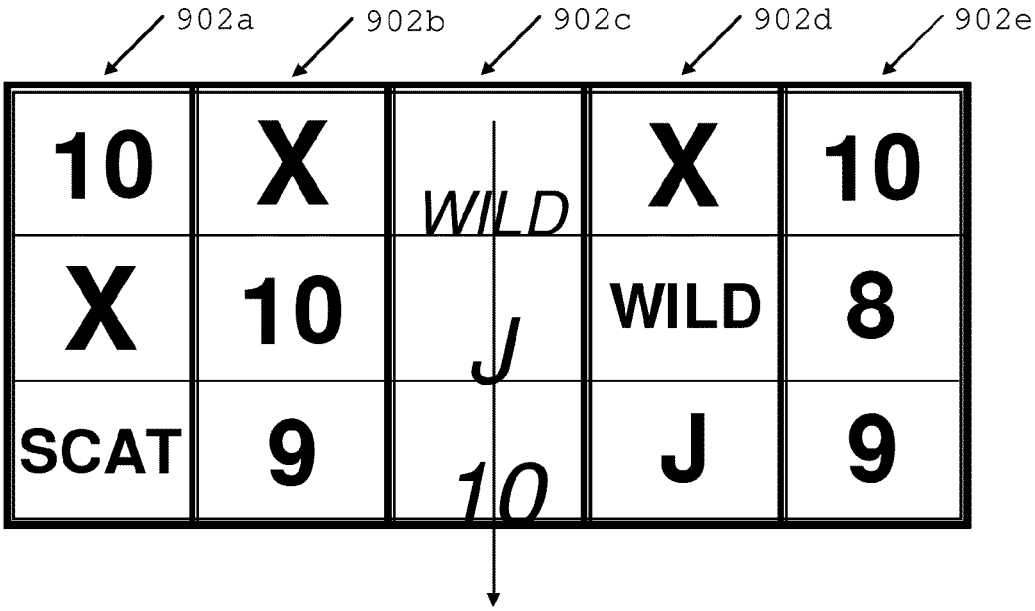

With reference to FIG. 9, there is shown a five reel multi-line game (the five reels designated by the reference numerals 902*a*, 902*b*, 902*c*, 902*d*, 902*e*, respectively) which awards a jackpot prize A, B or C for any combination of three, four or five "X" jackpot symbols respectively left to right on a selected pay line. After the first reel spin has been carried out (and first game outcomes determined by the outcome determined 623), the re-selection module 626 references re-spin criteria 642 stored in memory 64 to determine which reels are to be re-spun and additionally, the number of re-spins. In this case, the reel spin criteria 642 specifies that for each credit bet per line above one credit, a reel is to be re-spun a corresponding number of times. In this case the reel spin criteria is also used to select the third reel 902*c* for re-spin, because jackpot symbols occur in the same pay line on both the second reel 902*b* and the fourth reel 902*d*. Additional criteria may also be specified such as, for example, if a jackpot symbol appears during a re-spin of reel 3 902*c* in line with the jackpot symbols on reels two 902*b* and four 209*d* then reel five 902*e* can be selected for any further re-spins. For example, according to FIG. 9, the player has wagered "3" credits per line and has selected 20 lines to play (i.e. for a total wager of 60 credits), the third reel 902*c* will be re-spun twice; once for each extra wager per line. According to the FIG. 9 embodiment, only jackpot related outcomes are determined during the reel re-spins.

Example 3

In the third example embodiment non-jackpot outcomes are evaluated and awarded during the reel re-spins. According to such an embodiment, the symbols carried by each reel (i.e. as specified by symbol data 641) may change according to the bet button; in other words, different symbol sets are assigned to each bet button, such that non-jackpot related outcomes evaluated during reel re-spins result in the same overall return to player, regardless of the credits wagered. Such an embodiment is suitable for scatter jackpot combinations relating to total credits wagered and line jackpot combinations relating to credits wagered per line.

Example 4

In a further example embodiment, a combination of reels are re-spun according to the wagered amount. For example, for a three reel line game as detailed in example 1, when 'X' occurs on the first reel 802*a*, the re-spin criteria 642 may specify that the second reel 802*b* is re-spun up to one less time than the number of lines played and for each of these combinations the third reel 802*c* is re-spun up to 1 less time than the bet per line. Thus a sequence of re-spins occurs where the first reel 802*a* is held stationary while reel 2 802*b* and reel 3 802*c* are re-spun. So if there are 3 lines and 3 credits bet per line reel two 802*b* will be re-spun twice (based on the number of lines played) and reel three 802*c* will be re-spun twice (based on the bet per line) for each of the base spin and the re-spins of reel two 802*b*, the third reel 802*c* may be reset to its original position for each re-spin of reel two 802*b*. In this embodiment the cumulative jackpot prize is evaluated at the end of each combination of re-spins. However, in an alternative embodiment a cumulative jackpot prize may be evaluated after each re-spin. An example game is shown below in Table 1.

TABLE 1

Reel Spin Example

| Spin | Reel 1 | Reel 2 | Reel 3 | Outcome |
|---|---|---|---|---|
| Base (first reel spin) | X | X | X | jackpot |
| Re-spin reel 3 | X (held) | X (held) | — | |
| Re-spin reel 3 | X (held) | X (held) | — | |
| Re-spin reel 2 with original reel 3 | X (held) | — | X (original) | |
| Hold new reel 2 and re-spin reel 3 | X (held) | — | — | |
| Hold new reel 2 and re-spin reel 3 | X (held) | — | X (new) | |
| Re-spin reel 2 with original reel 3 | X (held) | X (new) | X (original) | |
| Hold new reel 2 and re-spin reel 3 | X (held) | X (held) | — | |
| Hold new reel 2 and re-spin reel 3 | X (held) | X (held) | X (new) | jackpot |

In the base game reel spin (the first reel spin) a jackpot symbol occurs on each of the three reels so a jackpot prize is accumulated for this base outcome. The re-spin sequence begins by holding reels one 802*a* and two 802*b* in their original position and re-spinning reel 3 two times, in the example above no jackpot symbols occurred on reel three 802*c* during these two re-spins. The next re-spin is a re-spin of reel two 802*b* and for this re-spin reel three may be restored to its original position, showing a jackpot symbol. In the example table it is shown that no jackpot symbol appears for reel two 802*b* during this re-spin. Reel three 802*c* is then re-spun another two times, with this example showing a jackpot symbol occurring in the second of these re-spins. Next the second re-spin of reel two 802*b* occurs, with reel three 802*c* again re-set to its original position, and in the example a new jackpot symbol occurs on reel two 802*b*. Although jackpot symbols now appear on all of the three reels the re-spins of reel three 802*c* need to occur before jackpot evaluation in this embodiment. Reel three 802*c* is then re-spun twice with a new jackpot symbol occurring on reel three 802*c* in the second re-spin, thus a jackpot is accumulated for this final outcome. The accumulated jackpot can then be awarded to the player.

Example 5

According to this example embodiment, the game is a card game whereby a jackpot is awarded for a pair of aces occurring when two cards are drawn from a regular deck of 52 playing cards. If the first card drawn is an ace, then the second card may be re-drawn (i.e. re-spun/re-selected) a number of times according to the wagered amount. For example, if one credit wagered awards two cards then two credits wagered can provide a second draw of the second card in the event that the first card is an ace.

Similarly an embodiment may be a dice game where a jackpot is awarded for two sixes and the dice may be re-rolled a number of times according to the wagered amount.

It will be understood that for the above example embodiments, if the jackpot resulting symbols occur in scattered combinations (i.e. where the application of pay lines, regions or the like does not relate to the probability of qualifying jackpot symbol combinations), then the re-spins/draws occur according to the total amount wagered. However if the qualifying symbols must fall on selected lines, or other such qualifying regions of evaluation, then the regular play button or qualifying combination such as lines selected may already be factored into the probabilities and the re-spins are only required for consideration of the bet button, the amount bet per line, or per qualifying pattern, etc.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of gaming for use with a gaming machine a) playing a game having a plurality of reels and a plurality of pay lines, and b) having a controller, the method comprising:

receiving a wager amount per pay line on a number of the plurality of pay lines;

determining via the controller said amount wagered per pay line and said number of the plurality of pay lines wagered on said game;

spinning via the controller said plurality of reels to determine a first game outcome;

evaluating via the controller said first game outcome in accordance with: a) a plurality of predefined pay line criteria to determine whether an award is to be awarded for any of the wagered pay lines, and b) at least one jackpot criteria to determine whether a jackpot prize is to be awarded;

in response to the jackpot prize not being payable, re-spinning, only for the jackpot prize, via the controller a) at least one of said plurality of reels a first number of times based on said wagered amount per pay line and b) at least one of said plurality of reels a second number of times based on said number of pay lines wagered so as to determine in an additional number of further game outcomes whether the jackpot prize is to be awarded; and in response to the jackpot prize having been awarded, terminating the re-spinning for the jackpot prize.

2. A method of gaming as claimed in claim 1, the method further comprising selecting said at least one of said plurality of reels to be re-spun a first number of times and said at least one of said plurality of reels to be re-spun a second number of times so as to affect the probability of winning the jackpot prize in the game.

3. A method of gaming as claimed in claim 2, the method further comprising selecting said at least one of said plurality of reels to be re-spun a first number of times and said at least one of said plurality of reels to be re-spun a second number of times such that a probability of awarding the jackpot prize is proportional to the amount wagered per pay line and the number of the plurality of pay lines wagered.

4. A method of gaming as claimed in claim 1, the method further comprising making non-jackpot prizes ineligible from being awarded in the further game outcomes.

5. A method of gaming as claimed in claim 1, the method further comprising:

triggering a secondary game upon an award criterion being met in any of the reel spins; and determining whether to award the jackpot prize during the secondary game.

6. A method of gaming as claimed in claim 5, wherein the award criterion comprises a particular symbol, or symbol combination, being displayed as a result of the reel spins.

7. A method of gaming as claimed in claim 1, the method further comprising selecting said at least one of said plurality of reels to be re-spun a first number of times and said at least one of said plurality of reels to be re-spun a second number of times based on reel re-spin criteria.

8. A method of gaming as claimed in claim 7, wherein said reel re-spin criteria comprise a presence of a special symbol and a location of the special symbol.

9. A method of gaming as claimed in claim 1, the method further comprising allocating a percentage of each wager placed in the game to a jackpot prize pool which funds the jackpot prize.

10. A method of gaming as claimed in claim 1, the method further comprising making symbols available for selection in the spinning and also available for selection in the re-spinning.

11. A method of gaming as claimed in claim 1, wherein re-spinning of said at least one of said plurality of reels a second number of times comprises re-spinning said at least one of said plurality of reels n−1 times for a wager of n credits per pay line.

12. A method of gaming as claimed in claim 1, wherein re-spinning of said at least one of said plurality of reels a first number of times comprises re-spinning said at least one of said plurality of reels n×m−1 times for a wager of n credits for m pay lines.

13. A method as claimed in claim 1, the method further comprising the re-spinning different reels to determine each further game outcome.

14. A method of gaming for use with a gaming machine i) playing a game having a) a plurality of reels and a plurality of pay lines, and b) a plurality of designated symbol positions, and ii) a controller, the method comprising:

receiving a wager amount per pay line on a number of the plurality of pay lines;

determining said amount wagered per pay line and said number of the plurality of pay lines wagered on said game;

selecting symbols from a symbol set to display in said designated symbol positions;

determining from the resulting symbols a first game outcome;

evaluating said first game outcome in accordance with: a) a plurality of predefined pay line criteria to determine whether an award is to be awarded for any of the wagered pay lines, and b) at least one jackpot criteria to determine whether a jackpot prize is to be awarded;

in response to the jackpot prize not being payable, re-selecting symbols, only for the jackpot prize, for a) at least one of the designated symbol positions a first number of times depending on said amount wagered per pay line, and b) at least one of the designated symbol positions a second number of times depending on said number of the plurality of pay lines wagered, to provide in an additional number of further game outcomes whether the jackpot prize is to be awarded; and in response to the jackpot prize having been awarded, terminating the re-selecting for the jackpot prize.

15. A method as claimed in claim 14, the method further comprising:

providing through the first game outcome a first opportunity to award a jackpot prize; and providing through the further game outcomes further opportunities to award the jackpot prize.

16. A method as claimed in claim 15, the method further re-selecting the first number of times and the second number of times such that a probability of awarding the jackpot prize is proportional to said amount wagered per pay line and said number of the plurality of pay lines wagered in the game.

17. A method of gaming as claimed in claim 14, the method further comprising making non-jackpot prizes ineligible from being awarded in the further game outcomes.

18. A method of gaming as claimed in claim 14, the method further comprising:

triggering a secondary game upon an award criterion being met in any of the game outcomes; and determining whether to award the jackpot prize during the secondary game.

19. A method of gaming as claimed in claim 14, the method further comprising performing re-selecting symbols n−1 times for a wager of n credits per pay line.

20. A method of gaming as claimed in claim 14, wherein the game is a card game, and wherein re-selecting symbols comprises re-drawing one or more cards displaying the symbols.

21. A method of gaming as claimed in claim 14, wherein the game is a dice game and wherein re-selecting symbols comprises re-rolling one or more dice and displaying the symbols.

22. A game controller for a gaming device operable to a) display play of a reel game having a plurality of reels and a plurality of pay lines and b) receive a wager amount per pay line on a number of the plurality of pay lines, the game controller comprising:

a wager determination module configured to determine said amount wagered per pay line and said number of the plurality of pay lines wagered on said reel game; and an outcome determiner configured to:

determine a first outcome resulting from a reel spin of said plurality of reels;

evaluate said first outcome in accordance with: a) a plurality of predefined pay line criteria to determine whether an award is to be awarded for any of the wagered pay lines, and b) at least one jackpot criteria to determine whether a jackpot prize is to be awarded; and in response to the jackpot prize not being awarded, determine, only for the jackpot prize, in a number of further game outcomes whether the jackpot prize is to be awarded, the further game outcomes resulting from a first number of selected reel re-spins dependent on the determined wager amount per pay line and a second number of selected reel re-spins dependent on the determined number of the plurality of pay lines wagered; and in response to the jackpot prize having been awarded, terminate the determining for the jackpot prize.

23. A game controller as claimed in claim 22, further comprising a re-selection module configured to select at least one of said first number of selected reel re-spins and said second number of selected reel re-spins so as to affect the probability of winning the jackpot prize in said reel game.

24. A game controller as claimed in claim 23, further comprising a re-selection module configured to select said first number of reel re-spins such that a probability of awarding the jackpot prize in the game is proportional to the amount wagered.

25. A game controller as claimed in claim 22, further comprising an award determiner module configured to make non-jackpot prizes ineligible from being awarded in the further game outcomes.

26. A game controller as claimed in claim 22, further comprising a processor configured to initiate play of a secondary game upon an award criterion being determined in the first or further game outcomes and to determine whether to award the jackpot prize during the secondary game.

27. A game controller as claimed in claim 26, wherein the award criterion comprises in a particular symbol, or symbol combination being displayed.

28. A game controller as claimed in claim 22, further comprising a re-selection module configured to select which reel (s) to re-spin based on at least one of a presence of a special symbol and a location of the special symbol.

29. A game controller as claimed in claim 22, further comprising a symbol selector configured to randomly select symbols to display in the first and further game outcomes, and to make symbols available for selection in the reel spin and also available for selection in the reel re-spins.

30. A game controller for playing a game having a plurality of reels and a plurality of pay lines, on a gaming machine a) having a plurality of symbol positions and b) receiving a wager amount per pay line on a number of the plurality of pay lines, the game controller comprising:

a wager determination module configured to determine said amount wagered per pay line and said number of the plurality of pay lines wagered on said game;

a symbol selector configured to:

select symbols from a symbol set to display in said symbol positions;

determine from the resulting symbols a first game outcome;

evaluate said first game outcome in accordance with: a) a plurality of predefined pay line criteria to determine whether an award is to be awarded for any of the wagered pay lines, and b) at least one jackpot criteria to determine whether a jackpot prize is to be awarded; and in response to the jackpot prize not being payable, re-select symbols, only for the jackpot prize, for a) at least one of the symbol positions a first set number of times depending on said amount wagered per pay line, and b) at least one of the symbol positions a second number of times depending on said number of the plurality of pay lines wagered, to provide an additional number of further game outcomes in which the jackpot prize is to be awarded; and in response to the jackpot prize having been awarded, terminate the re-selection for the jackpot prize.

31. A game controller as claimed in claim 30, wherein the first game outcome provides a first opportunity to award a jackpot prize and the further game outcomes provide further opportunities to award the jackpot prize.

32. A gaming system for a) playing a game having a plurality of reels and a plurality of pay lines and b) receiving a wager amount per pay line on a number of the plurality of pay lines, the gaming system comprising:

a game controller comprising:

a wager determination module configured to determine said amount wagered per pay line and said number of the plurality of pay lines wagered on said game;

an outcome determiner configured to:

determine a first outcome resulting from a reel spin of said plurality of reels;

evaluate said first game outcome in accordance with: a) a plurality of predefined pay line criteria to determine whether an award is to be awarded for any of the wagered pay lines, and b) at least one jackpot criteria to determine whether a jackpot prize is to be awarded; and in response to the jackpot prize not being payable, determine, only for the jackpot prize, in a number of further game outcomes whether the jackpot prize is to be awarded, the further game outcomes resulting from a first number of selected reel re-spins dependent on the determined wager amount per pay line and a second number of selected reel re-spins dependent on the determined number of the plurality of pay lines wagered; and in response to the jackpot prize having been awarded, terminate the determining for the jackpot prize; and at least one gaming device providing a display configured to display play of said game.

* * * * *